US006533636B2

(12) United States Patent
Holenstein et al.

(10) Patent No.: US 6,533,636 B2
(45) Date of Patent: Mar. 18, 2003

(54) CD SPACER

(75) Inventors: Dylan Holenstein, Media, PA (US); Bruce D. Holenstein, Media, PA (US)

(73) Assignee: Gravic, Inc., Paoli, PA (US)

( * ) Notice: Subject to any disclaimer, the term of this patent is extended or adjusted under 35 U.S.C. 154(b) by 0 days.

(21) Appl. No.: 09/925,318

(22) Filed: Aug. 9, 2001

(65) Prior Publication Data

US 2003/0032364 A1 Feb. 13, 2003

(51) Int. Cl.[7] ..... A63H 1/30
(52) U.S. Cl. ..... 446/250; 446/247
(58) Field of Search ..... 446/250, 248, 446/247

(56) References Cited

U.S. PATENT DOCUMENTS

| | | | | | |
|---|---|---|---|---|---|
| 60,961 | A | * | 1/1867 | Syrcher | 446/250 |
| 179,377 | A | | 6/1876 | Weber | |
| 271,278 | A | * | 1/1883 | Schoenfeld | 446/250 |
| 1,311,534 | A | | 7/1919 | Seymour | |
| 4,393,618 | A | | 7/1983 | Ray | |
| 4,555,235 | A | | 11/1985 | Burroughs | |
| 5,131,882 | A | * | 7/1992 | Kiyokane | 446/431 |
| 6,089,945 | A | * | 7/2000 | Van Dan Elzen | 446/250 |
| 6,142,850 | A | * | 11/2000 | Levy | 446/250 |

* cited by examiner

*Primary Examiner*—Derris H. Banks
*Assistant Examiner*—Urszula M Cegielnik
(74) *Attorney, Agent, or Firm*—Akin Gump Strauss Hauer & Feld, L.L.P.

(57) ABSTRACT

A spacer for building a toy yo-yo includes a central axis for receiving a tether string for wrapping around the central axis and two outer sidewalls, each outer sidewall having an attachment hub disposed on the outer sidewall for receiving a compact disc. The spacer in combination with two compact discs may form a toy yo-yo. The spacer may also be included in a kit for building a toy yo-yo where the user supplies the compact discs separately.

9 Claims, 9 Drawing Sheets

CD SPACER

BACKGROUND OF THE INVENTION

The present invention relates to toys and more specifically, to a spacer for building a toy yo-yo in combination with compact discs.

A compact disc (CD) is a disc developed by Sony and Philips that can store, on the same disc, still and/or moving images in monochrome and/or color; stereo or two separate sound tracks integrated with and/or separate from the images; and digital program and information files. A standard compact disc has a diameter of 4.72 inches. Other, less popular sizes exist.

Compact discs are so economical to produce that they have flooded the consumer and commercial markets as advertising and demonstration tools, and for use in one-time software installation. Consumers receive so many compact discs in the mail or with purchased products that they may have no use for these compact discs. The present invention provides a use for these compact discs. More specifically, the present invention provides for a spacer which can be used to build a toy yo-yo by clipping or gluing the compact discs to the outer sidewalls of the spacer.

Toy yo-yos or bandilures date back to at least to the 1800s. Such spinning toys are well known and are generally made by two sidewalls, a central axis and a string. The string is wrapped about the central axis tautly. A user then unrolls the string in a downward fashion, thus spinning the sidewalls and central axis. Then, with a generally upward motion at the end of the string, the user gently pulls on the string such that the central axis begins to rewind up the string. Toy yo-yos are described in U.S. Pat. Nos. 179,377; 1,311,534; 4,393,618 and 4,555,235. Building a toy yo-yo or bandilure is not inventive, however, building a toy yo-yo as a method of reusing compact discs for another purpose is the primary intent of the present invention. It is the intent of the present invention to not only recycle unneeded compact discs, but to also provide a toy for amusement purposes.

BRIEF SUMMARY OF THE INVENTION

The present invention provides for a spacer for building a toy yo-yo. The spacer comprises a central axis for receiving a tether string for wrapping around the central axis and two outer sidewalls. Each outer sidewall has an attachment hub disposed on the outer sidewall for receiving a compact disc. The diameter of the outer sidewalls may have the same diameter as the central axis, or may be other diameters or shapes. The attachment hub may be a compact disc clip. Alternatively, the attachment hub may be a generally cylindrically shaped body sized to snugly receive a central hole of a compact disc so that the compact disc may be glued to the outer sidewall while being kept snugly in place against the outer sidewall. The attachment hub may be a compact disc clip, and the compact disc clip may be a deflectable hub with at least one slit which eases removal and attachment of the compact disc and engages the compact disc to hold the compact disc securely in place.

Another embodiment of the present invention provides for a toy yo-yo having a spacer. The spacer includes a central axis for receiving a tether string for wrapping around the central axis and two outer sidewalls. Each outer sidewall has an attachment hub disposed on the outer sidewall. The diameter of the outer sidewalls may have the same diameter as the central axis, or may be other diameters or shapes. The toy yo-yo also comprises two compact discs, and each compact disc is attached to one of the outer sidewalls. The toy yo-yo may have an attachment hub that is a compact disc clip. Alternatively, the toy yo-yo may have an attachment hub that is a generally cylindrically shaped body sized to snugly receive a central hole of a compact disc so that the compact disc may be glued to the outer sidewall while being kept snugly in place against the outer sidewall.

An alternate embodiment of the present invention provides for a kit for building a toy yo-yo. The kit for building a toy yo-yo comprises a spacer including a central axis for receiving a tether string for wrapping around the central axis, two outer sidewalls each having an attachment hub disposed on the outer sidewall, and instructions for attaching two compact discs to each of the outer sidewalls. The diameter of the outer sidewalls may have the same diameter as the central axis, or may be other diameters or shapes.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
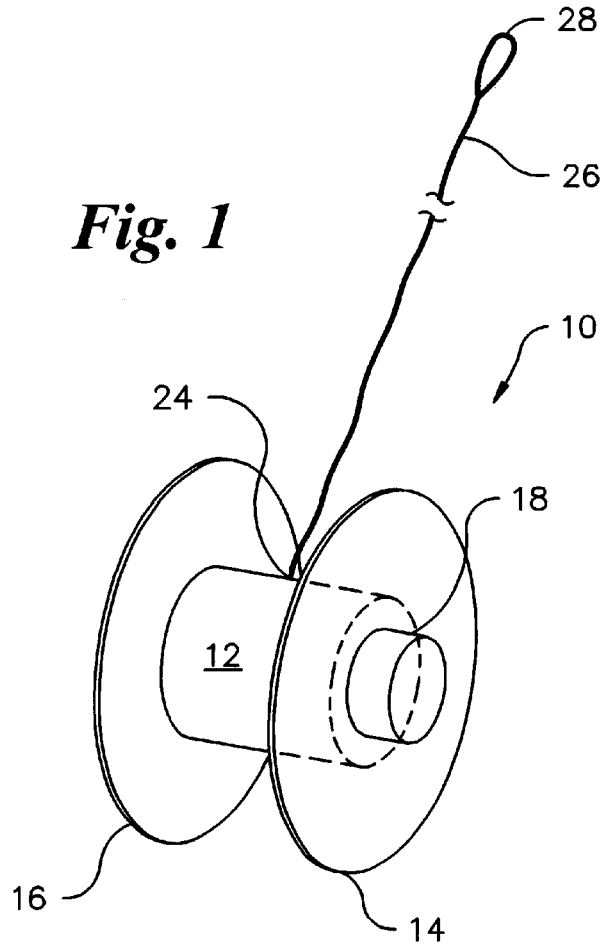
FIG. 1. is a perspective view of a spacer for building a toy yo-yo.
Figure 2:
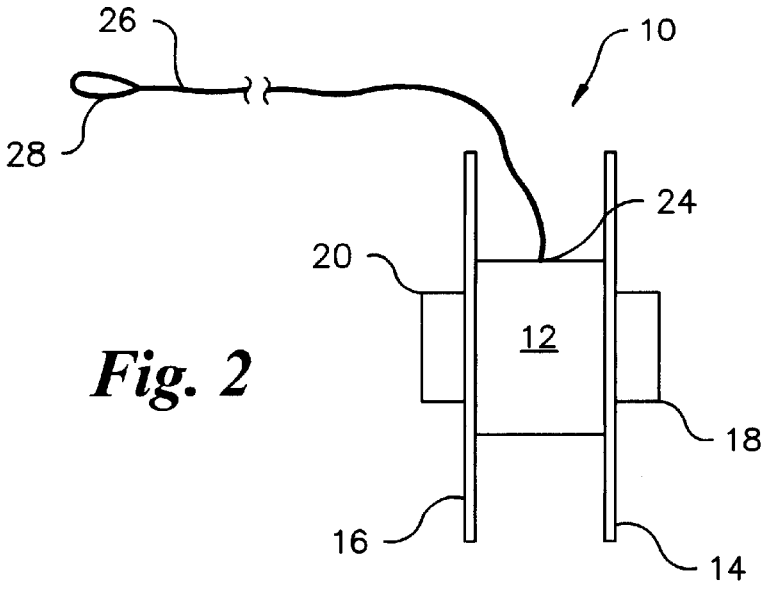
FIG. 2 is a front view of a spacer for building a toy yo-yo.

FIGS. 1 and 2 show a spacer 10 for building a toy yo-yo. The spacer 10 comprises a central axis 12 for receiving a tether string 26 which wraps around the central axis 12, a first outer sidewall 14, and a second outer sidewall 16. The first outer sidewall 14 has a first attachment hub 18 disposed thereon. The second outer sidewall 16 has a second attachment hub 20 disposed thereon. The diameter of the outer sidewalls 14, 16 may have the same diameter as the central axis 12, or may be other diameters or shapes. The attachment hubs 18, 20 receive a compact disc (not shown). The tether string 26 is coupled to the central axis 12 by a tether string fastener 24. The tether string fastener 24 may be a hole through the central axis 12 so as to allow the string 26 to be looped through the hole (not shown). Alternatively, the tether string fastener 24 may be a rivet or pin (not shown), a simple loop about the central axis 12 by the tether string 26, or any suitable means for attaching the tether string 26 to the central axis 12. The method of attaching the tether string 26 or the tether string fastener 24 is not critical to the present invention and is therefore not discussed in more detail herein. The tether string 26 also has a tether string loop 28 so as to allow a user to temporarily secure the tether string 26 to the user's finger while utilizing a toy yo-yo assembled from the spacer 10.

Figure 6A:
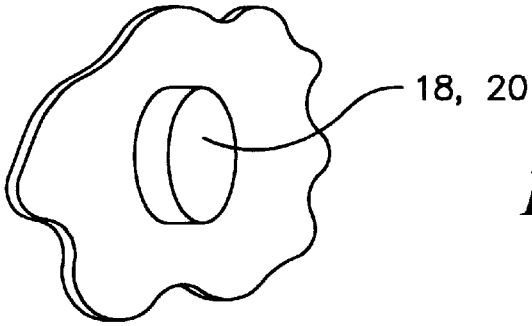
FIG. 6*a* is a perspective view of a generally cylindrically shaped attachment hub.
Figure 6B:
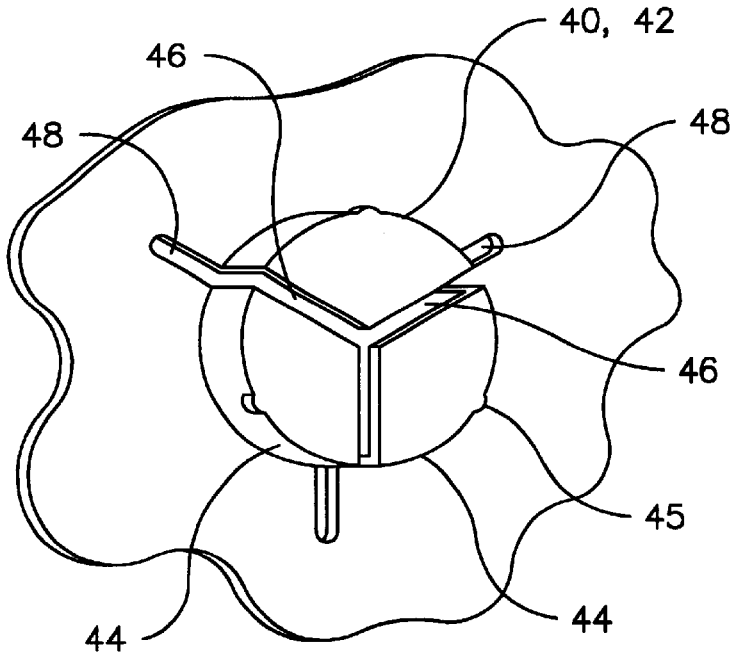
FIG. 6*b* is a perspective view of a compact disc clip that is a deflectable hub.
Figure 6C:
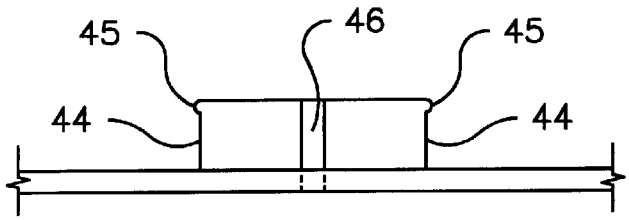
FIG. 6*c* is a side elevation view of the compact disc clip of FIG. 6*b*.

The attachment hubs 18, 20 are generally cylindrically shaped bodies sized to snugly receive a first central hole 36 of a compact disc 32 and a second central hole 38 of a compact disc 34, respectively. The attachment hubs 18, 20 are sized so that the compact discs 32, 34 may be glued to the outer sidewalls 14, 16 while being kept snugly in place against the outer sidewalls 14, 16. Alternatively, FIGS. 6*b* and 6*c* show another embodiment of the spacer 10 wherein the attachment hub has a first compact disc clip 40 and a second compact disc clip 42. The compact disc clips 40, 42 may be a deflectable hub with at least one slit 46 which eases removal and attachment of a compact disc 32, 34 and engages the compact disc 32, 34 to hold the compact disc 32, 34 securely in place. The compact disc clip 40, 42 may also have hub segments 44 which include segment ridges 45 for engaging the compact disc 32, 34 once the compact disc 32, 34 is pressed over the hub segments 44 and the hub segments 44 have returned to their original upright position after being deflected into slits 46.

Figure 5:
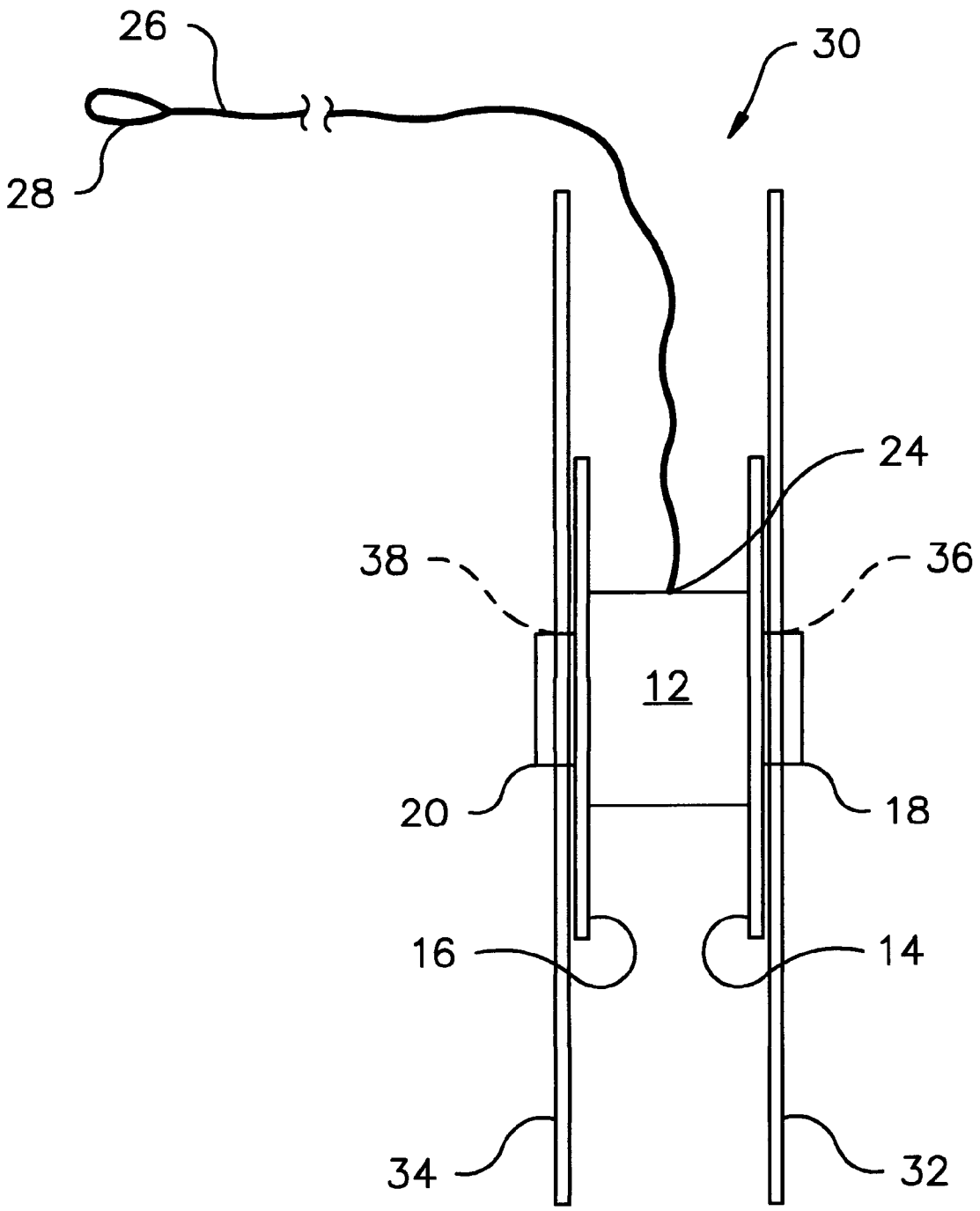
FIG. 5 is a front view of a toy yo-yo formed with a spacer and two compact discs.

FIG. 5 shows another embodiment of the present invention wherein a toy yo-yo 30 is formed from a spacer 10 and two compact discs 32, 34. The toy yo-yo comprises a spacer 10 that includes a central axis 12 for receiving a tether string 26 which wraps around the central axis 12. The spacer 10 further comprises two outer sidewalls 14, 16 having attachment hubs 18, 20 disposed on the outer sidewalls 14, 16. The diameter of the outer sidewalls 14, 16 may have the same diameter as the central axis 12, or may be other diameters or shapes. The toy yo-yo 30 has two compact discs 32, 34 attached to each of the outer sidewalls 14, 16 respectively. The compact discs 32, 34 have generally circular holes 36, 38 located generally at their center. The holes 36, 38 are aligned over the attachment hubs 18, 20 and placed such that the outer sidewalls 14, 16 are flush with the generally flat surfaces of the compact discs 32, 34. The compact discs 32, 34 are glued to the outer sidewalls 14, 16.

Figure 3A:
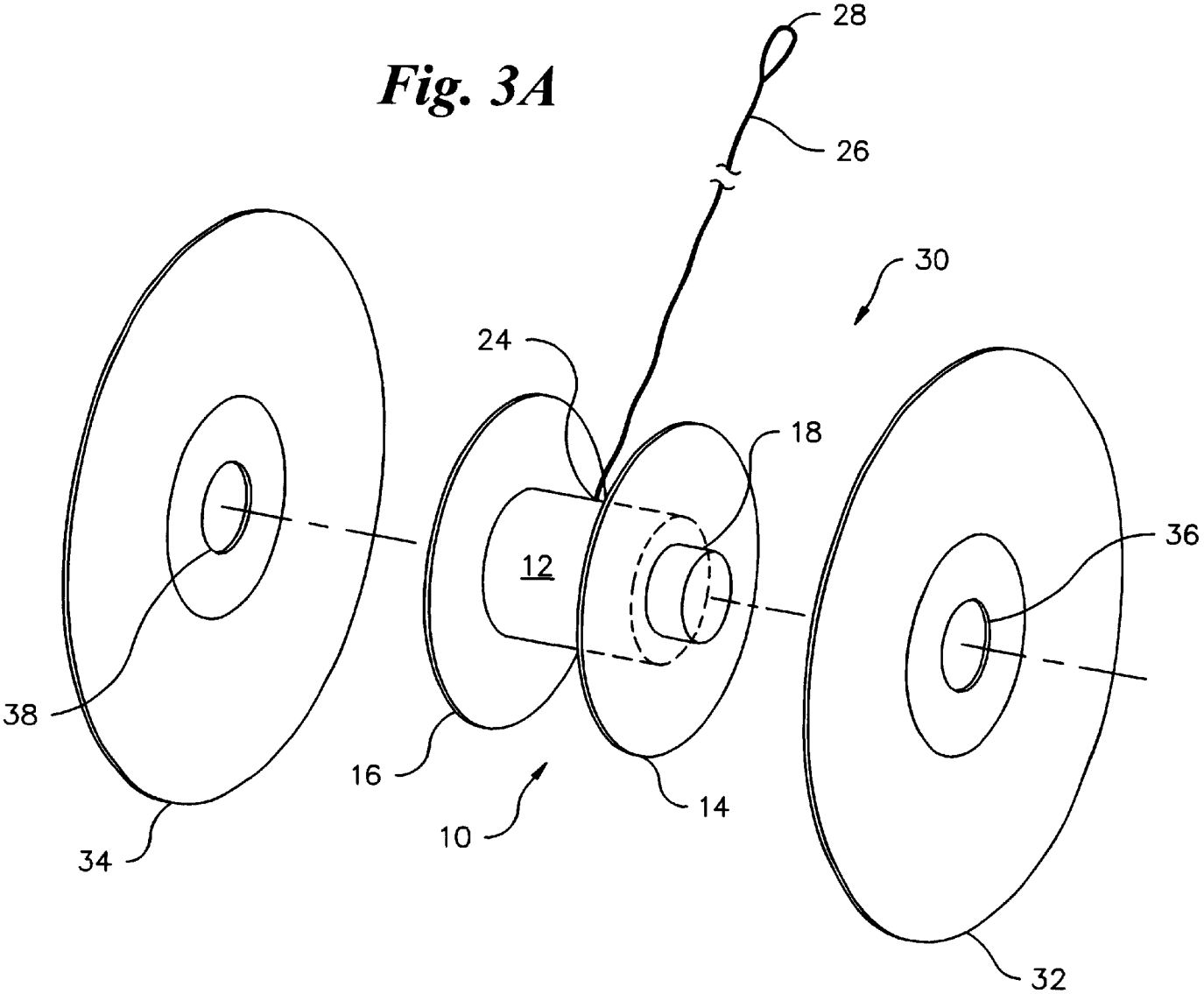
FIG. 3A is a perspective view of an unassembled toy yo-yo including a spacer and two compact discs.
Figure 4A:
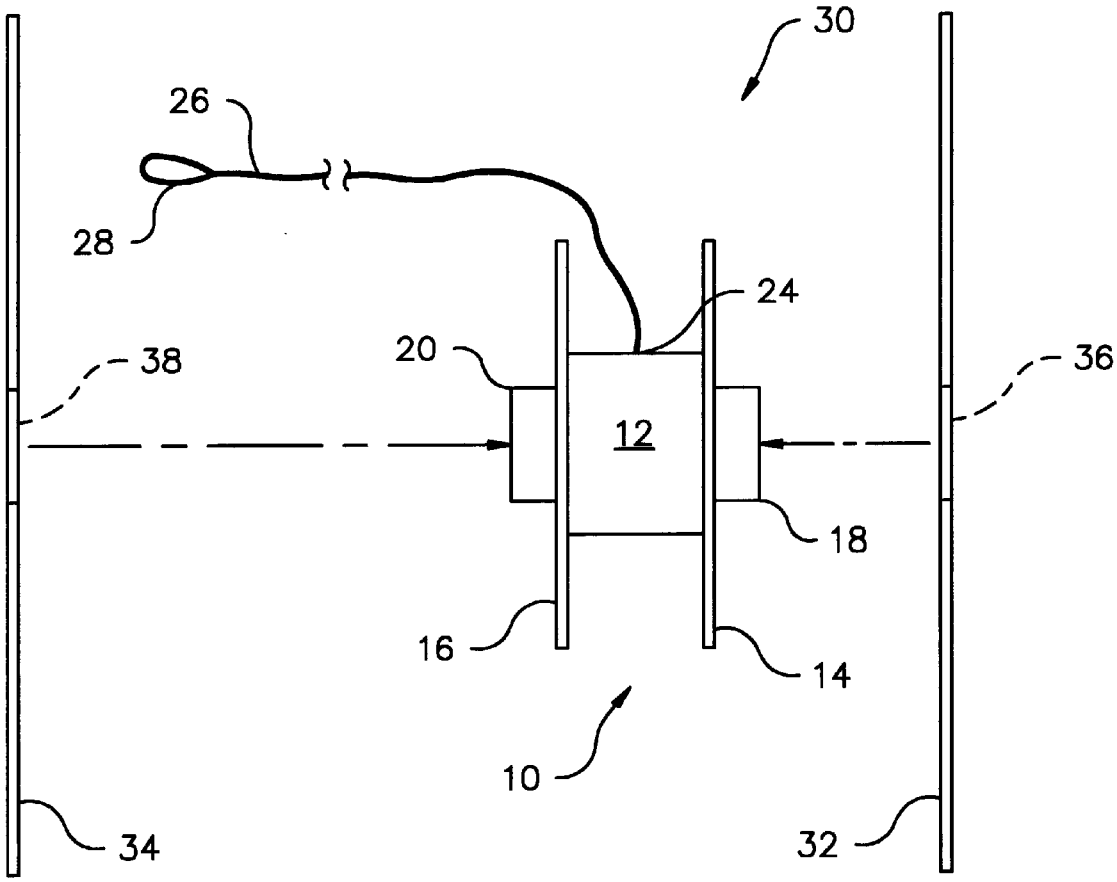
FIG. 4A is a front view of the unassembled yo-yo shown in FIG. 3A.

FIGS. 3A and 4A show another embodiment of the present invention that includes a kit for building a toy yo-yo 30. The kit for building a toy yo-yo 30 comprises a spacer 10 which has a central axis 12 for receiving a tether string 26 which wraps around the central axis 12 and two outer sidewalls 14, 16 each further having an attachment hub 18, 20 disposed thereon. The diameter of the outer sidewalls 14, 16 may have the same diameter as the central axis 12, or may be other diameters or shapes. The kit also includes instructions (not shown) for attaching two compact discs 32, 34 to each of the outer sidewalls 14, 16 respectively. The compact discs 32, 34 may be provided in the kit, but the compact discs 32, 34 may also be provided separately by the user in order to recycle compact discs 32, 34 while not being used for data or music purposes.

Figure 3B:
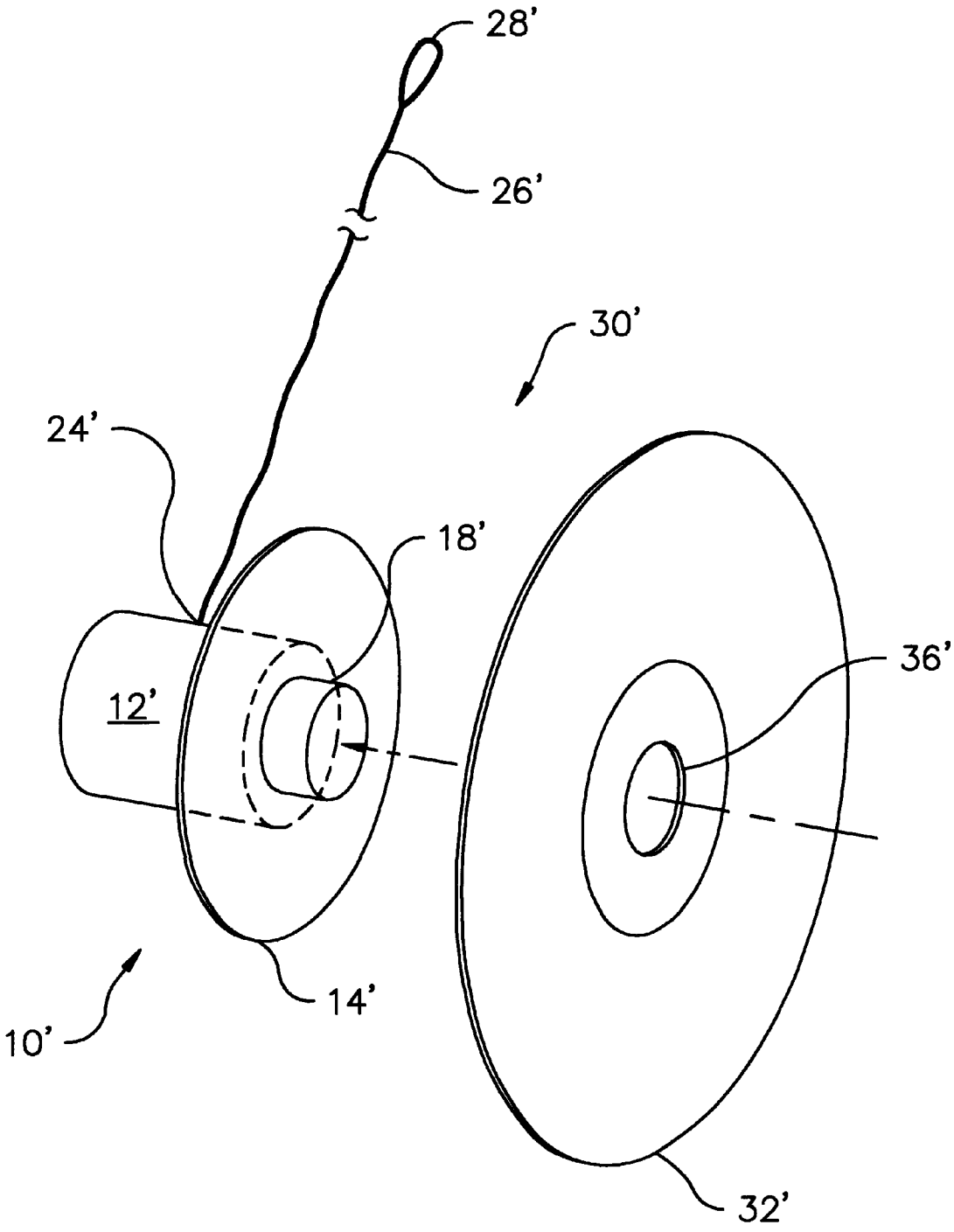
FIG. 3B is a perspective view of an unassembled toy yo-yo including a spacer and one compact disc.
Figure 4B:
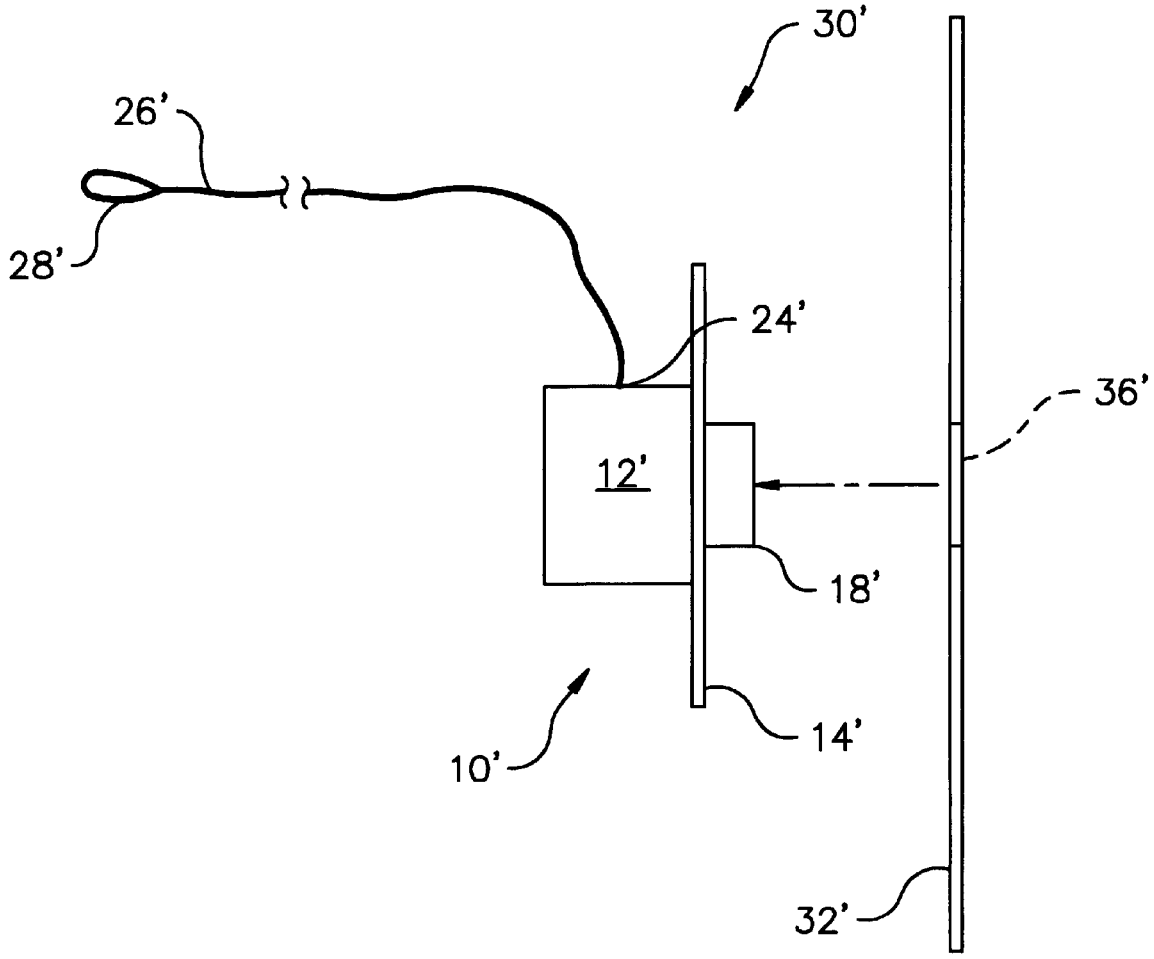
FIG. 4B is a front view of the unassembled yo-yo shown in FIG. 3B.

FIGS. 3B and 4B show a fourth embodiment of the present invention that includes a kit for building a toy yo-yo 30'. The kit for building a toy yo-yo 30' comprises a spacer 10' which has a central axis 12' for receiving a tether string 26' which wraps around the central axis 12' and one outer sidewall 14' further having an attachment hub 18' disposed thereon. The diameter of the outer sidewall 14' may have the same diameter as the central axis 12', or may be other diameters or shapes. The kit also includes instructions (not shown) for attaching at least one compact disc 32' to the outer sidewall 14'. The compact disc 32' may be provided in the kit, but the compact disc 32' may also be provided separately by the user in order to recycle a compact disc 32' while not being used for data or music purposes. The toy yo-yo 30' with a single compact disc 32' attached to the outer sidewall 14' is much more challenging to use due to the reduced stability. The high angular momentum produced by the larger moment of inertia enables the toy yo-yo 30' to maintain a close to upright orientation with additional control from the user (not shown).

Figure 3C:
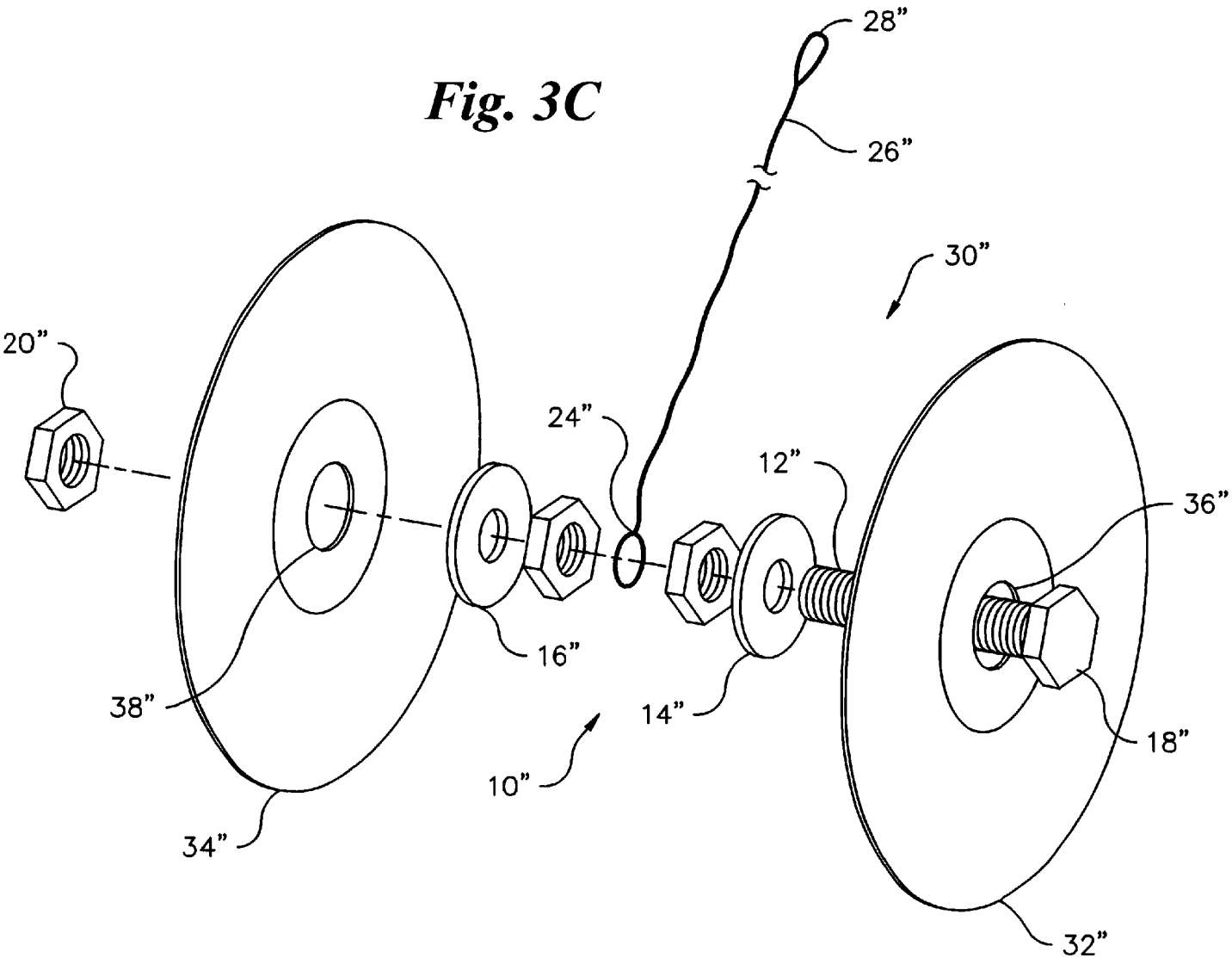
FIG. 3C is a perspective view of another embodiment of an unassembled toy yo-yo including a spacer and two compact discs.
Figure 4C:
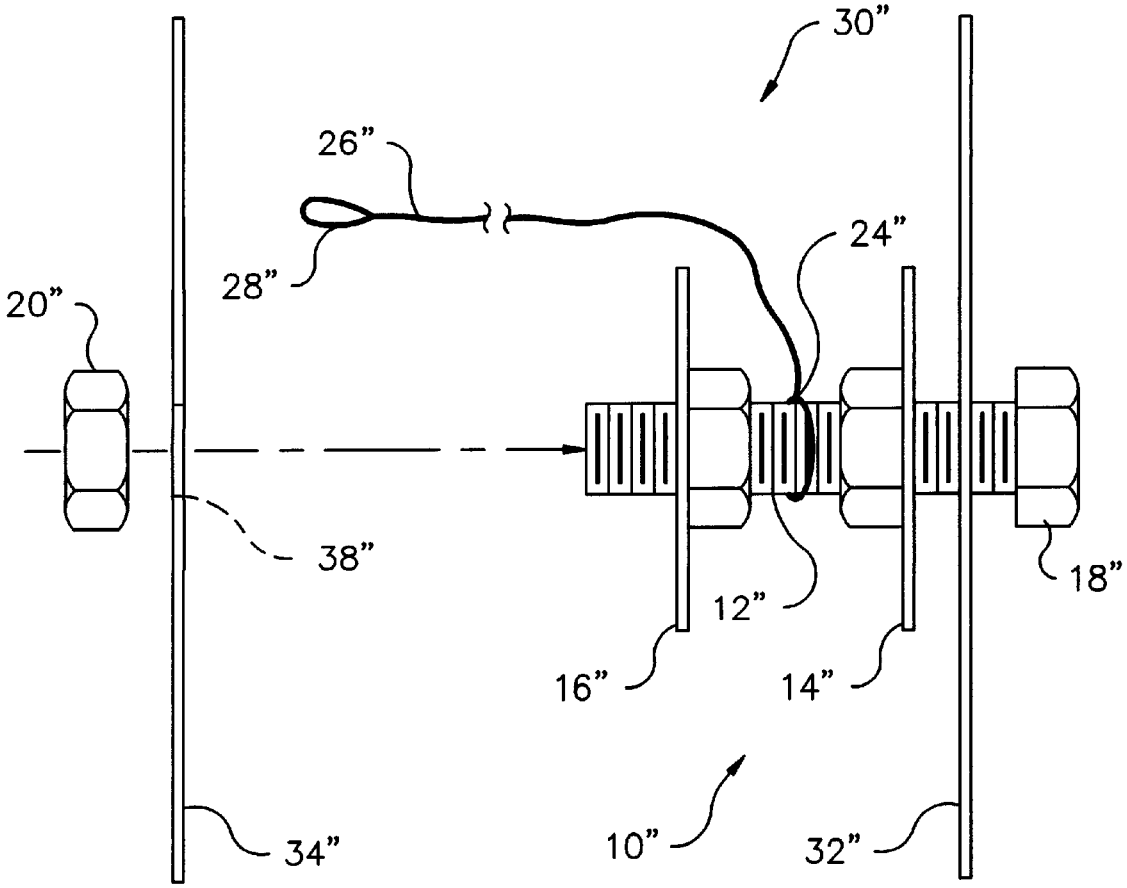
FIG. 4C is a front view of the unassembled yo-yo shown in FIG. 3C.

FIGS. 3C and 4C show a fifth embodiment of the present invention that includes a kit for building a toy yo-yo 30". The kit for building a toy yo-yo 30" comprises a spacer 10" which has a central axis 12" which is a bolt or threaded rod for receiving a tether string 26' which wraps around the central axis 12" and outer sidewalls 14", 16" which are washers or nuts further having attachment hubs 18", 20" which are nuts or washers with nuts disposed thereon. However, one skilled in the art should recognize that the central axis 12" need not be a threaded rod, but may be any pipe, rod, shaft or the like, and that the attachment hubs 18", 20" need not be nuts, but may be cotter pins, snap rings, o-rings, or other similar attachment mechanisms. The kit also includes instructions (not shown) for attaching compact discs 32", 34" to the outer sidewalls 14", 16", respectively. The instructions (not shown) may be the only thing provided in the kit, and the user (not shown) may acquire all of the parts from a hardware store or the like. The compact discs 32", 34" may be provided in the kit, but the compact discs 32", 34" may also be provided separately by the user in order to recycle compact discs 32", 34" while not being used for data or music purposes.

Some compact discs for games, operation & maintenance manuals, vendor catalogs, music or even installation software include a graphic embossed on one or both surfaces of the compact disc. In addition, vendors may print their company logos, product description, and/or contact information on the surfaces of the compact discs. The spacers may be given out with the compact discs as a promotion at trade shows, conventions, demonstrations, in mailers or the like. Music or software stores may give away the spacers with new purchases as a way to entice customers to stop using previously purchased materials. Users may collect compact discs with fancier graphics for creating yo-yos that look different, or they may trade or sell yo-yos made from interesting compact discs.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A toy yo-yo comprising:

a) a spacer including:

i) a central axis for receiving a tether string for wrapping around the central axis, and ii) two outer sidewalls, each outer sidewall having an attachment hub disposed thereon; and b) two compact discs, each compact disc attached to one of the outer sidewalls.

2. The spacer of claim 1 wherein the central axis is a bolt, the head of said bolt is one of the two attachment hubs and the other attachment hub is a nut.

3. The spacer of claim 1 wherein the central axis is a threaded rod.

4. The spacer of claim 1 wherein the central axis is a threaded pipe.

5. A spacer for building a toy yo-yo, the spacer comprising:

a) a central axis for receiving a tether string for wrapping around the central axis; and b) two outer sidewalls, each outer sidewall having an attachment hub disposed thereon for receiving a compact disc, wherein the attachment hub is a compact disc clip.

6. The spacer of claim 5 wherein the compact disc clip is a deflectable hub with at least one slit which eases removal and attachment of a compact disc and engages the compact disc to hold the compact disc securely in place.

7. A spacer for building a toy yo-yo, the spacer comprising:

a) a central axis for receiving a tether string for wrapping around the central axis; and b) two outer sidewalls, each outer sidewall having an attachment hub disposed thereon for receiving a compact disc, wherein the attachment hub is a generally cylindrically shaped body sized to snugly receive a central hole of a compact disc so that the compact disc may be glued to the outer sidewall while being kept snugly in place against the outer sidewall.

8. A spacer for building a toy yo-yo, the spacer comprising:

a) a central axis for receiving a tether string for wrapping around the central axis; and b) two outer sidewalls, each outer sidewall having an attachment hub disposed thereon for receiving a compact disc, wherein the central axis is a bolt, the head of said bolt is one of the two attachment hubs and the other attachment hub is a nut, and wherein the attachment hub is a compact disc clip.

9. A spacer for building a toy yo-yo, the spacer comprising:

a) a central axis for receiving a tether string for wrapping around the central axis; and b) two outer sidewalls, each outer sidewall having an attachment hub disposed thereon for receiving a compact disc, wherein the central axis is a bolt, the head of said bolt is one of the two attachment hubs and the other attachment hub is a nut, and wherein the attachment hub is a generally cylindrically shaped body sized to snugly receive a central hole of a compact disc so that the compact disc may be glued to the outer sidewall while being kept snugly in place against the outer sidewall.

* * * * *